United States Patent [19]

Hill, Jr. et al.

[11] Patent Number: 4,937,894

[45] Date of Patent: Jul. 3, 1990

[54] DUAL FLUSH TOILET

[76] Inventors: Russell L. Hill, Jr., 16472 Grimaud La., Huntington Beach, Calif. 92649; Robert K. Hitchcock, 5504 Donner St., Buena Park, Calif. 90621

[21] Appl. No.: 395,023

[22] Filed: Aug. 17, 1989

[51] Int. Cl.[5] ..... E03D 1/35

[52] U.S. Cl. ..... 4/324; 4/379; 4/404; 4/415

[58] Field of Search ..... 4/324, 325, 378, 379, 4/388, 392, 393, 395, 403, 404, 415

[56] References Cited

U.S. PATENT DOCUMENTS

| | | | |
|---|---|---|---|
| 281,713 | 12/1985 | Mikol | D23/19 |
| 3,026,536 | 3/1962 | Wood | 4/324 |
| 3,375,531 | 4/1968 | Lake | 4/326 |
| 3,590,395 | 7/1971 | Wustner | 4/324 |
| 3,943,577 | 3/1976 | Woolf | 4/325 |
| 3,955,218 | 5/1976 | Ramsey | 4/324 |
| 3,964,109 | 5/1976 | Street | 4/327 |
| 4,160,294 | 7/1979 | Crumby | 4/324 |
| 4,189,795 | 2/1980 | Conti | 4/324 |
| 4,225,987 | 10/1980 | Goldman | 4/325 |
| 4,388,736 | 6/1983 | Roosa | 4/324 |
| 4,411,029 | 10/1983 | Huang | 4/324 |
| 4,419,773 | 12/1983 | Sullivan | 4/392 |
| 4,504,984 | 3/1985 | Buns | 4/326 |
| 4,530,119 | 7/1985 | Chiu et al. | 4/324 |
| 4,593,419 | 6/1986 | Derus | 4/324 |
| 4,620,331 | 11/1986 | Sagucio | 4/325 |
| 4,655,244 | 4/1987 | Park | 137/412 |

*Primary Examiner*—Henry J. Recla
*Assistant Examiner*—Glenn T. Barrett
*Attorney, Agent, or Firm*—Fulwider, Patton, Reiber, Lee & Utecht

[57] ABSTRACT

A valve assembly for selectively allowing either a partial or a complete draining of a toilet flush tank. A hollow valve member having both a small vent hole and a larger opening therein is selectively pivoted in a first or or a second direction depending upon which one of two activation levers is depressed. Opening the valve by pivoting it in one direction allows trapped air to vent from within the hollow valve. Inflowing water eventually imparts a negative buoyancy to the valve assembly and allows it to settle onto the valve seat to seal the tank prior to the discharge of the entire volume of water held by the flush tank. Alternatively, opening the valve by pivoting it in the opposite direction allows substantially less air to escape by virtue of the placement of the vent hole. The valve therefore never achieves negative buoyancy and the entire tank drains before the valve can settle onto its valve seat to seal the tank.

5 Claims, 1 Drawing Sheet

FIG. 1
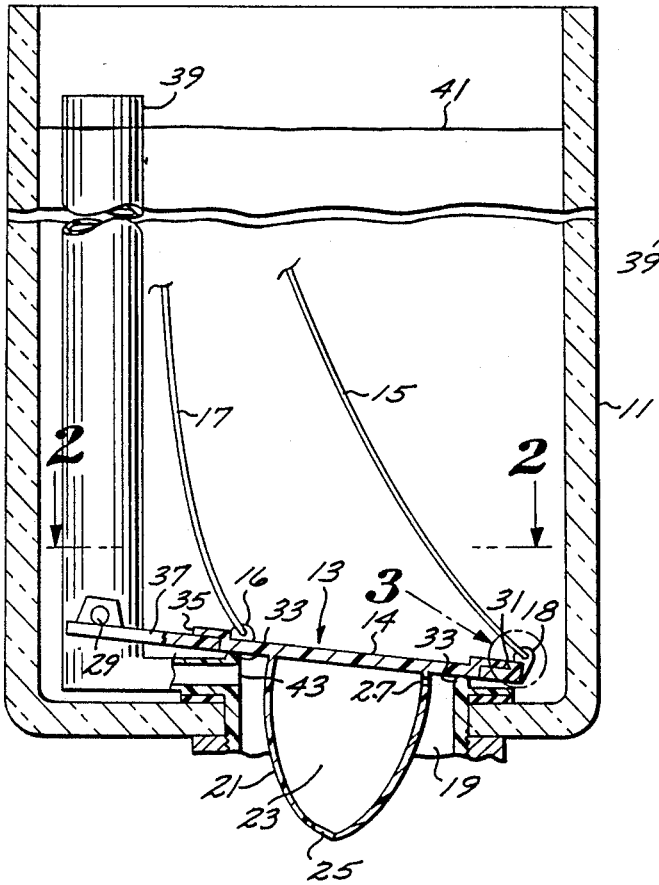
FIG. 2
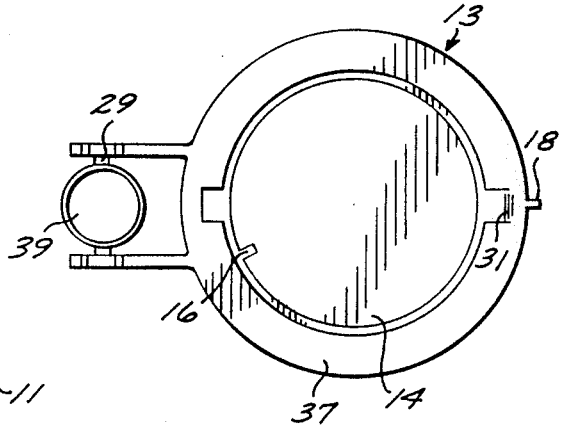
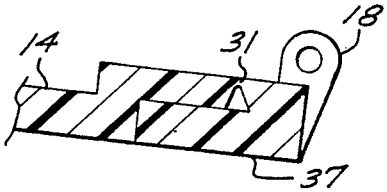
FIG. 3
FIG. 4
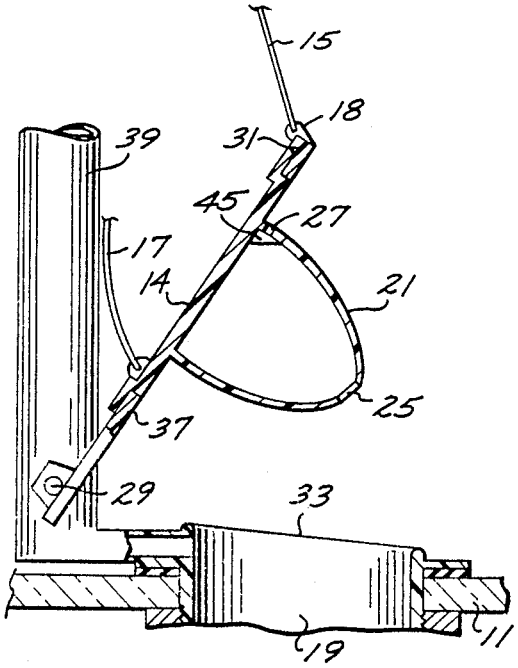
FIG. 5
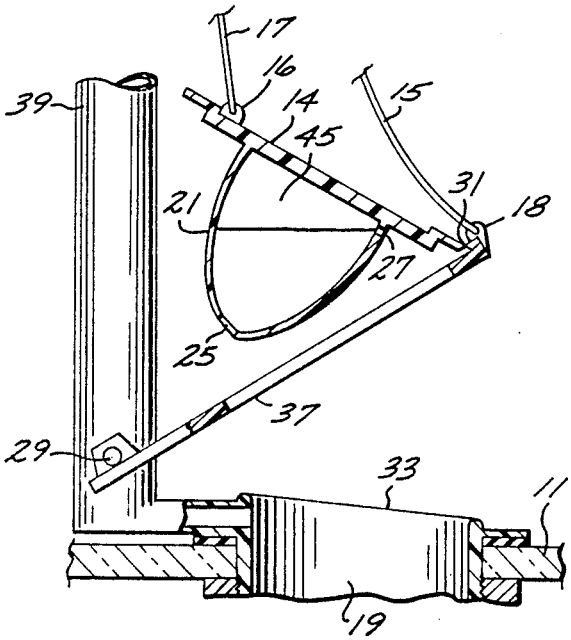

DUAL FLUSH TOILET

Background of the Invention

This invention relates to the art of valve construction and more particularly pertains to a toilet valve which enables selective control of the amount of water used during the flushing operation.

The conventional flush toilets in general use discharge the entire amount of water stored in a tank upon each flushing operation even though only a fraction of that quantity of water may be required In the interest of water conservation, valve assemblies have been disclosed for operation within a toilet flush tank to deliver different volumes of flush water. A number of different approaches have been employed including the adaptation of multiple valve assemblies disposed at different heights within the flush tank. Selective activation of one or the other valve allows the water level to recede to to the opened valve's particular height thereby controlling the amount of water released. Lake U.S. Pat No. 3,375,531 and Burns U.S. Pat No. 4,504,984 are representative examples of such designs. Alternatively, designs are disclosed in Ramsey U.S. Pat. No. 3,955,218 and Roosa, et al. U.S. Pat. No. 4,388,736 wherein the valve can manually be held open until or pushed closed after a desired amount of water has drained from the flush tank. Derus U.S. Pat. No. 4,593,419 and Goldman, et al. U.S. Pat. No. 4,225,987 each describe valve assemblies which permit a predetermined amount of air trapped within the flush valve to be vented therefrom at a selectable rate. Air trapped within the valve effects its buoyancy and as soon as a sufficient amount has been vented therefrom and the valve attains negative buoyancy, it settles into its valve seat to shut off the flow of water from the flush tank. Conti, et al. U.S. Pat. No. 4,189,795 employs a similar principle but instead of controlling the rate of air venting from the valve, the rate at which water fills the interior of the discharge valve, to displace air venting therefrom, is controlled. A further approach for providing a dual stage flushing action is described by Crumby U.S. Pat. No. 4,160,294 and Street, et al. U.S. Pat. No. 3,964,109 in which a single activation lever is adapted to raise one or both of two concentric valve elements as a function of the degree of rotation of the lever. Each valve element is connected to its own respective float arranged at a different height above the valve element within the flush tank. Once a valve element has been lifted off its valve seat, its float causes it to remain open until the water level has receded sufficiently to allow the valve to close.

The prior art methods and devices for regulating the amount of water used in flushing suffer from the disadvantage of being relatively complicated and/or requiring substantial alteration of the existing hardware, some even calling for modification of the flush tank itself. In addition, devices such as disclosed in U.S. Pat. No. 3,955,218 are inconvenient to operate requiring the lever to be manually depressed during the entire flushing operation. It is further to be noted that the location of bulky components such as extra floats within the flush tank reduce the maximum volume of water that can be stored and hence used during a flushing operation.

SUMMARY OF THE INVENTION

The general purpose of this invention is to provide a simple flush valve assembly that allows a flush tank to either partially or completely drain by simply depressing a first or a second lever. To attain this, the present invention provides for a hollow flush valve seated on the bottom of the flush tank that can be opened by pivoting in either a first or a second direction. A small vent hole disposed on one side of the tank valve allows trapped air to vent only when the valve is pivoted in a first direction and not when pivoted in a second direction. The venting of air allows water to fill the tank valve, imparts a negative buoyancy thereto and allows it to settle back onto the valve seat before all the water has drained from the tank. If no air is vented, the valve remains afloat until all the water has drained from the flush tank at which point it once again effects a seal. Two flusher handles are inserted through the tank's existing flusher handle hole and are each separately interconnected with the flush valve to cause it to pivot in it either the first or the second direction upon activation of the respective handle. Simply depressing one or the other handle causes the flush tank to be partially or completely drained.

Installation of the device in a conventional flush tank is easily accomplished. No modification of the tank is required, the existing valve seat is employed, existing pivot points are utilized and the dual flusher handles are inserted through the existing handle hole. The device is simple to operate, functions in a simple manner, does not reduce the capacity of the flush tank, and is substantially maintenance free.

BRIEF DESCRIPTION OF THE DRAWINGS

Other objects and many of the attendant advantages of this invention will readily be appreciated as the same becomes better understood by reference to the following detailed description when considered in conjunction with the accompanying drawings in which like reference numerals designate like parts throughout the figures thereof and wherein:

FIG. 1 is a cross-section of a flush tank employing the valve assembly of the present invention;

FIG. 2 is an enlarged top plan view of the flush valve assembly of the present invention taken along lines 2—2 of FIG. 1;

FIG. 3 is a further enlargement in cross-section of a portion of the valve assembly of the present invention;

FIG. 4 is a cross-section of the valve assembly of the present invention as actuated to allow only a partial draining of the flush tank;

FIG. 5 is a cross-section of the valve assembly of the present invention as actuated to allow complete draining of the flush tank.

DETAILED DESCRIPTION OF THE PREFERRED EMBODIMENT

The figures generally illustrate both the structure of the valve assembly of the present invention and its two modes of operation. FIG. 1 illustrates the flush valve assembly 13 as installed at the bottom of a toilet flush tank 11. In its closed position, the valve assembly 13 allows the flush tank to be filled. Typically a valve and float assembly (not shown) is employed to achieve and maintain a predetermined water level 41 within the tank. An overflow tube 39 is provided to prevent the overflow of the tank should the valve and float assembly fail to limit said water level. The overflow tube conducts any excess water to a point 43 beyond that which is sealed off by the valve assembly 13. Upon opening the flush valve 13, water is conducted via duct 19 to the toilet bowl.

The valve assembly 13 of the present invention consists of a circular sealing member 14 which seats against valve seat 33 to seal off the flush tank from duct 19. The water pressure exerted by the water stored within the flush tank serves to press the sealing member 14 against the valve seat 33 to effect a positive seal. A hollow bulbous member 21 projects below or is incorporated within the sealing member 14 and encloses an air chamber 23. An opening 25 is disposed near the bottom of the bulbous member 21 while a small vent hole 27 is located near the bulbous member's outer periphery just below the location of the sealing member 14. The valve member 14 is pivotally connected to ring member 37 which in turn is pivotally connected to a convenient point within the flush tank 11 such as to the overflow tube 39. The locations of the pivot points 31 and 29 are preferably diametrically opposed from one another across the valve member 14 with vent hole 27 being disposed near one of the pivot points. As illustrated in FIG. 4, when the first pull chain 15 is pulled, the entire valve assembly 13 is pivoted about pivot point 29, and vent hole 27 faces upwardly. Conversely, when the second pull chain 17 is pulled (FIG. 5), the valve member 14 is pivoted about pivot point 31. Actuation by the second pull chain 17 also causes a pivoting of the ring member 37 about pivot point 29. The selective pulling of either pull chain can be accomplished by a dual operating mechanism (not shown). Such an operating mechanism may have two handles, each operating a separate rod and interconnected with its respective pull chain.

In operation, depending upon which pull chain is pulled determines how much water is discharged from the flush tank. As illustrated in FIG. 4 when the first pull chain 15 is pulled the entire assembly pivots about point 29. In this position the air vent hole 27 allows all air trapped within the air chamber 23 of the bulbous member 21 to escape and thereby allows water to enter through hole 25. As soon as an amount of water has entered the bulb sufficient to impart a negative buoyancy to the entire assembly, the valve assembly 13 settles towards the bottom to once again effect a seal between valve member 14 and valve seat 33 thereby curtailing the discharge of water through duct 19. The size of hole 27 is selected such that the bulbous member fills with a sufficient quantity of water to impart the required negative buoyancy in a time period in which only a partial and pre-selected amount of water stored within the flush tank 11 has discharged through duct 19. Once the valve assembly is in its closed position, water that had entered the bulbous member 21 can freely drain out through hole 25. Such is the operation of the device in its water conserving mode.

In order to allow the entire flush tank to drain, the second pull chain 17 is pulled to lift the valve assembly 13 off its seat 33 as is illustrated in FIG. 5. The location of the hole in this position allows a substantially smaller portion of air to escape through hole 27. The air remaining in the air pocket 45 above the water level within the air chamber 23 is sufficient to maintain a positive buoyancy for the entire valve assembly 13. As a result the assembly will float on top of the receding water line 41 and only when the entire volume of water has drained from the tank will the valve assembly settle onto valve seat 33. In this mode pivoting will occur about both points 29 and 31.

Many modifications and variations of the present invention are possible in light of the above teachings and is therefore to be understood that within the scope of the appended claims the invention may be practiced otherwise than as specifically described.

What is claimed is:

1. A dual mode valve assembly for selectively allowing a first or a second quantity of water to drain from a flush tank, comprising:

a sealing member for selectively sealing off a discharge duct extending from below the flush tank by seating against a valve seat;

an air chamber, affixed to said sealing member extending below said seating member into said discharge duct, having an air vent therein and an opening located near a bottom portion;

a first means for pivoting said sealing member off said seat in a first direction relative to the air vent so as to allow any air trapped within said air chamber to escape through the air vent and water to enter said air chamber through said opening to thereby impart a negative buoyancy to the entire valve assembly allowing it to settle onto the valve seat to reseal the discharge duct while submerged;

a first actuation means for causing said sealing member to pivot off said seat in the first direction;

a second pivot means for pivoting said sealing member off said valve seat in a second direction relative to the air vent so as to prevent air trapped within the air chamber from escaping through said vent hole to thereby allow the entire valve assembly to maintain a positive buoyancy and prevent it from resealing the discharge duct while submerged; and, a second actuation means for causing said sealing member to pivot off said seat in the second direction.

2. The valve assembly of claim 1 wherein the first pivoting means comprises an annular ring member pivotally attached within said flush tank and supporting said sealing member such that the air vent of the air chamber affixed thereto is in a diametrically opposed location relative to the ring member's pivotal attachment point and points substantially upwardly when the ring member is pivoted about its attachment point by said first actuation means.

3. The valve member of claim 2 wherein the second pivoting means comprises a pivotal attachment of the sealing member to the ring member at a location on the ring member diametrically opposed to the ring member's pivotal attachment within the flush tank so that said air vent points substantially downwardly when the seal member is pivoted relative to the ring member by second actuation means.

4. The valve assembly of claim 3 wherein said first actuation means comprises a pull chain attached to the ring member at a substantially diametrically opposed location relative to the ring members point if attachment.

5. The valve assembly of claim 4 wherein said second actuation means comprises a pull chain attached to said sealing member at a substantially diametrically opposed location relative to the seal member's point of attachment to the ring member.

* * * * *